US008107871B2

(12) United States Patent
Finn et al.

(10) Patent No.: US 8,107,871 B2
(45) Date of Patent: Jan. 31, 2012

(54) APPARATUSES USEFUL FOR PRINTING AND METHODS OF TREATING MARKING MATERIAL ON MEDIA

(75) Inventors: Patrick James Finn, Webster, NY (US); David C. Irving, Avon, NY (US); Robert S. Pawlik, Canandaigua, NY (US)

(73) Assignee: Xerox Corporation, Norwalk, CT (US)

( * ) Notice: Subject to any disclaimer, the term of this patent is extended or adjusted under 35 U.S.C. 154(b) by 442 days.

(21) Appl. No.: 12/432,374

(22) Filed: Apr. 29, 2009

(65) Prior Publication Data

US 2010/0278569 A1 Nov. 4, 2010

(51) Int. Cl.
*G03G 15/20* (2006.01)

(52) U.S. Cl. ..... 399/334; 399/329; 399/330

(58) Field of Classification Search ..... 399/329, 399/330, 334; 219/216
See application file for complete search history.

(56) References Cited

U.S. PATENT DOCUMENTS

| | | | | |
|---|---|---|---|---|
| 5,212,528 | A * | 5/1993 | Matsuda | 399/33 |
| 5,546,173 | A * | 8/1996 | Hinotani et al. | 399/331 |
| 6,564,033 | B2 | 5/2003 | Zhou et al. | |
| 6,574,449 | B2 * | 6/2003 | Yoda et al. | 399/329 |
| 6,650,863 | B2 * | 11/2003 | Fuma | 399/329 |
| 7,228,082 | B1 | 6/2007 | Davidson et al. | |
| 7,457,557 | B2 | 11/2008 | Roof et al. | |
| 7,747,195 | B2 * | 6/2010 | Yoshino et al. | 399/122 |
| 2003/0228179 | A1 | 12/2003 | Yaomin et al. | |
| 2005/0006370 | A1 | 1/2005 | Suzumi | |
| 2005/0036809 | A1 | 2/2005 | Fukita et al. | |
| 2005/0078990 | A1 * | 4/2005 | Shiraishi | 399/329 |
| 2006/0127144 | A1 * | 6/2006 | Watanabe | 399/329 |
| 2006/0171749 | A1 * | 8/2006 | Tomita et al. | 399/329 |
| 2006/0245800 | A1 * | 11/2006 | Fujino | 399/329 |
| 2007/0258741 | A1 * | 11/2007 | Kim et al. | 399/329 |
| 2008/0166160 | A1 * | 7/2008 | Fukaya et al. | 399/328 |
| 2010/0124446 | A1 * | 5/2010 | Kladias et al. | 399/328 |

OTHER PUBLICATIONS

View of portion of Canon Model No. MF5550 Multifunction Machine.

* cited by examiner

*Primary Examiner* — David Gray
*Assistant Examiner* — G. M. Hyder
(74) *Attorney, Agent, or Firm* — Richard A. Castellano; Prass LLP

(57) ABSTRACT

Apparatuses useful for printing and methods of treating marking material on media are provided. An exemplary embodiment of the apparatuses includes a first member including a first outer surface; and a roll including a second outer surface forming a nip with the first outer surface. The second outer surface includes an inner portion having first and second axially-spaced edges, a roughened first high-friction surface axially outward from the first edge and a roughened second high-friction surface axially outward from the second edge. The first and second high-friction surfaces extend circumferentially around the roll and have a higher roughness than the inner portion. The inner portion and the first and second high-friction surfaces contact the first outer surface at the nip, and the first and second high-friction surfaces lie outside of a media path through the nip.

17 Claims, 4 Drawing Sheets

APPARATUSES USEFUL FOR PRINTING AND METHODS OF TREATING MARKING MATERIAL ON MEDIA

BACKGROUND

Some printing apparatuses include a nip defined by opposed members. In such apparatuses, images are formed on media using a marking material and the media are fed to the nip where the members treat the marking material.

It would be desirable to provide apparatuses useful for printing and methods of treating marking material on media having more consistent performance.

SUMMARY

Apparatuses useful for printing and methods of treating marking material on media are provided. An exemplary embodiment of the apparatuses useful for printing comprises a first member including a first outer surface; and a roll including a second outer surface forming a nip with the first outer surface. The second outer surface includes an inner portion having first and second axially-spaced edges, a roughened first high-friction surface axially outward from the first edge and a roughened second high-friction surface axially outward from the second edge. The first and second high-friction surfaces extend circumferentially around the roll and have a higher roughness than the inner portion. The inner portion and the first and second high-friction surfaces contact the first outer surface at the nip, and the first and second high-friction surfaces lie outside of a media path through the nip.

DRAWINGS

DETAILED DESCRIPTION

Figure 1:
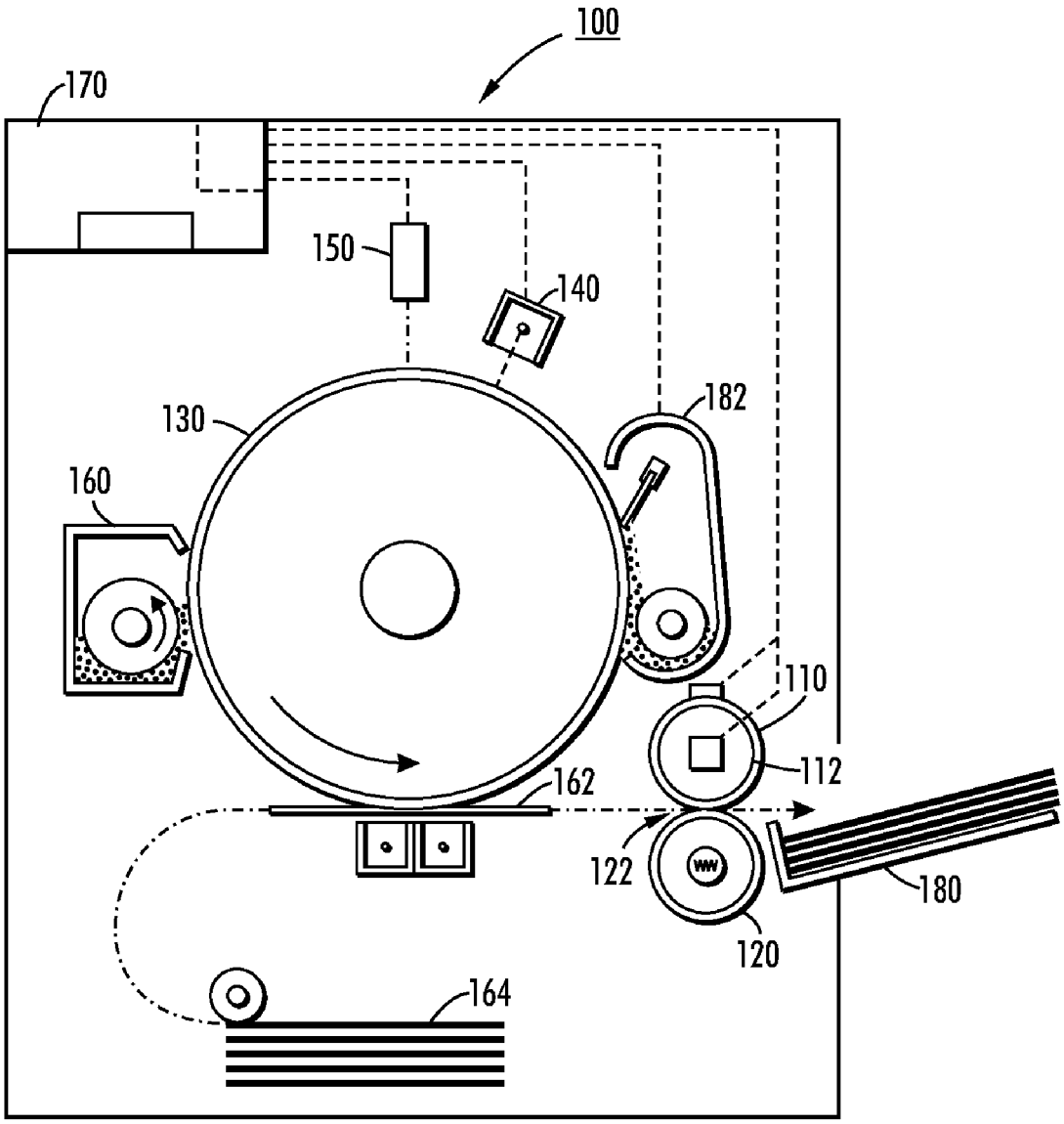
FIG. 1 depicts an exemplary embodiment of a printing apparatus.

The disclosed embodiments include an apparatus useful for printing comprising a first member including a first outer surface; and a roll including a second outer surface forming a nip with the first outer surface, the second outer surface including an inner portion having first and second axially-spaced edges, a roughened first high-friction surface axially outward from the first edge and a roughened second high-friction surface axially outward from the second edge, the first and second high-friction surfaces extending circumferentially around the roll and having a higher roughness than the inner portion. The inner portion and the first and second high-friction surfaces contact the first outer surface at the nip, and the first and second high-friction surfaces lie outside of a media path through the nip.

The disclosed embodiments further include an apparatus useful for printing comprising a first member including a first inner portion having first and second axially-spaced edges, a first high-friction surface axially outward from the first edge and a second high-friction surface axially outward from the second edge, the first and second high-friction surfaces extending circumferentially around the first member and being comprised of a first high-friction material having a higher coefficient of friction than a material forming the first inner portion; and a roll including a second outer surface forming a nip with the first outer surface, the second outer surface including a second inner portion having third and fourth axially-spaced edges, a third high-friction surface axially outward from the first edge and a fourth high-friction surface axially outward from the fourth edge, the third and fourth high-friction surfaces extending circumferentially around the roll and being comprised of a second high-friction material having a higher coefficient of friction than a material forming the second inner portion. The first high-friction surface contacts the third high-friction surface, the second high-friction surface contacts the fourth high-friction surface, and the first inner portion contacts the second inner portion, and the first, second, third and fourth high-friction surfaces lie outside of a media path through the nip.

The disclosed embodiments further include a method of treating marking material on media in an apparatus useful for printing comprising a continuous belt including a first outer surface, and a roll including a second outer surface forming a nip with the first outer surface, the second outer surface including an inner portion having first and second axially-spaced edges, a roughened first high-friction surface axially outward from the first edge and a roughened second high-friction surface axially outward from the second edge, the first and second high-friction surfaces each extending circumferentially around the roll and having a higher roughness than the inner portion. The method comprises feeding a medium carrying marking material to the nip; and contacting the medium with the first outer surface and the inner portion of the roll to treat the marking material at the nip, the first and second high-friction surfaces lying outside of a media path through the nip and not contacting the medium.

As used herein, the term "printing apparatus" encompasses any apparatus, such as a digital copier, bookmaking machine, multifunction machine, and the like, that performs a print outputting function for any purpose. The printing apparatuses can use various thermal, pressure and other conditions to treat the marking material and form images on media. The printing apparatuses can be used to produce prints from various media, such as coated or uncoated (plain) paper sheets, having various sizes and weights.

FIG. 1 illustrates an exemplary printing apparatus 100 disclosed in U.S. Pat. No. 7,228,082, which is incorporated herein by reference in its entirety. The printing apparatus 100 includes a fuser 110 with a rotatable, continuous belt 112 and a pressure roll 120 defining a nip 122. The printing apparatus 100 further includes a rotatable photoreceptor 130. To form a toner image on the photoreceptor 130, a charging device 140 is activated to charge the outer surface of the photoreceptor 130. The photoreceptor 130 is rotated to an exposure device 150, which forms an electrostatic latent image on the photoreceptor 130. Then, the photoreceptor 130 is rotated to a developer device 160, which applies toner particles to the electrostatic latent image to form the toner image on the photoreceptor 130. The toner image is transferred from the photoreceptor 130 to a medium 162, e.g., a sheet of paper, conveyed from a sheet supply stack 164. The medium 162 carrying the toner image is conveyed to the nip 122 of fuser 110. The printing apparatus 100 includes a controller 170 adapted to control operation of the image-forming devices during printing. After the medium 162 passes through the nip 122, the medium is conveyed to an output tray 180. A cleaning device 182 removes residual toner particles from the photoreceptor 182 before the imaging process is repeated for another medium.

Some fusers include only one driven roll that supplies the drive force to turn members, such as pressure members, fuser members, oiling systems, external or internal heat members, steering rollers, surface conditioning members (e.g., cleaning webs and metering blades), and the like. These members contribute additional drag to the fuser system.

Fusers can include a belt (fuser belt) and a roll that provides the drive force to the belt largely via media and images on the media. It has been noted that the minimum force sufficient to turn the driven members of the fuser can approximate, or may even exceed, the force that can be delivered by the roll, resulting in slip or even stall in the fusers. For example, for rolls having low-friction coatings, the minimum torque sufficient to turn the belt can approximate the torque that the roll surface can transmit to imaged media. It has further been noted that when these members cause excessive drag, slip occurring in the system can degrade system performance by preventing proper feeding of media to the nip, decreasing media stripping effectiveness, and/or reducing image quality on media.

In light of these observations, apparatuses useful for printing that include one or more high-friction surfaces (drive areas) outside of the media path in the apparatuses are provided. The high-friction surfaces can be provided on one or more, or on all, drive or driven members of the apparatuses. For example, the drive member can be a roll, such as a pressure roll or heat roll, and the driven member can be a roll or a belt. The high-friction surfaces are effective to increase the amount of force that can be transmitted between members including the high-friction surfaces and other members that contact these members (and may optionally also include high-friction surfaces), thereby reducing, and desirably eliminating, slip or stall in the apparatuses. Additionally, the high-friction surfaces allow a smaller portion of the drive force between members to be transmitted through the images and media than without the high-friction surfaces, allowing better image quality to be achieved.

Figure 2:
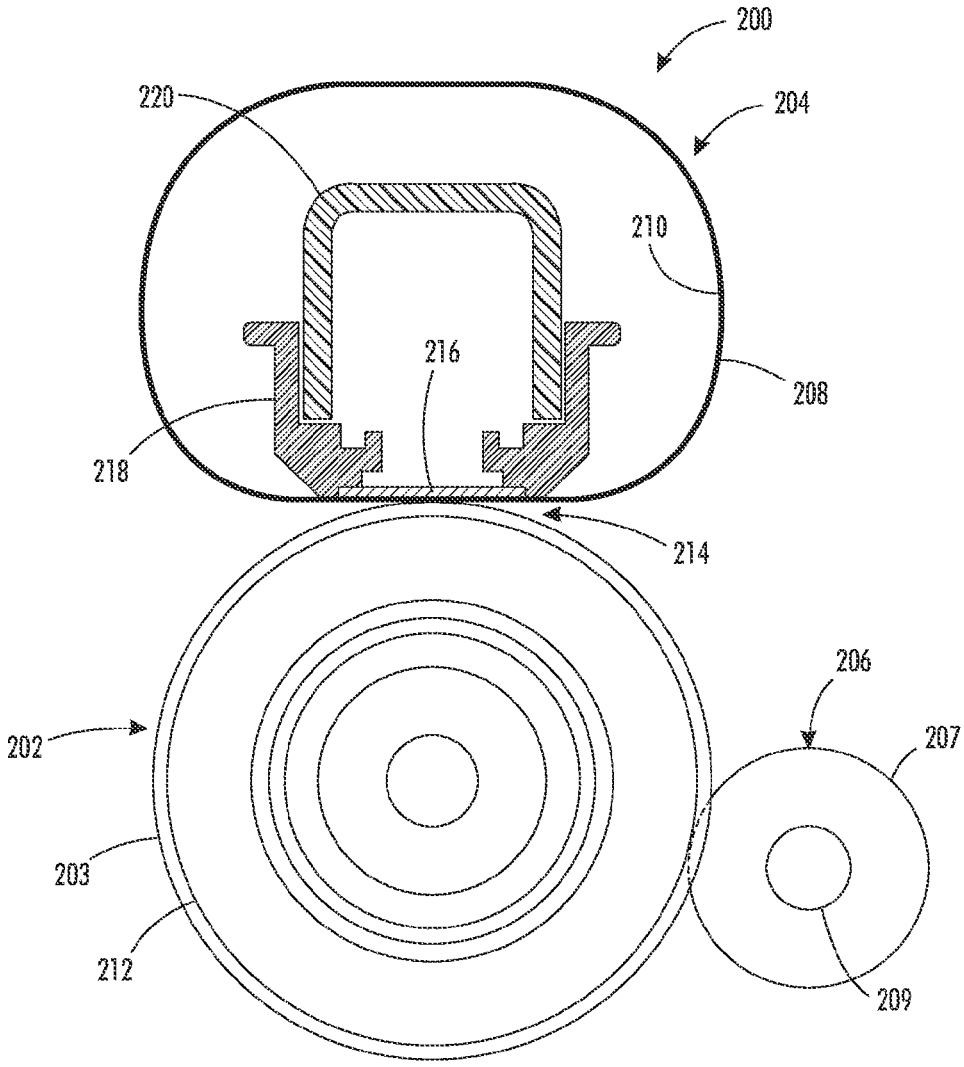
FIG. 2 depicts an exemplary embodiment of a fuser including a pressure roll and a belt having an internal heater.
Figure 3:
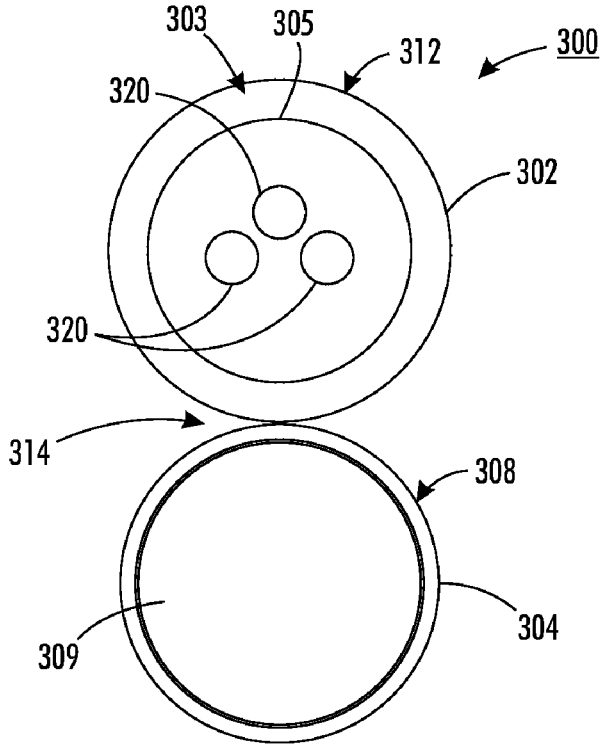
FIG. 3 depicts another exemplary embodiment of a fuser including a heat roll and a belt.

FIGS. 2 and 3 illustrate exemplary embodiments of apparatuses useful for printing. The apparatus shown in FIG. 2 is a fuser 200. Embodiments of the fuser 200 can be used, e.g., in the printing apparatus 100 in place of the fuser 110. The exemplary fuser 200 includes a pressure roll 202 and a continuous belt 204. The belt 204 includes an outer surface 208 and an inner surface 210. The pressure roll 202 includes an outer surface 203 contacting the outer surface 208 of the belt 204 to form a nip 214. A heat distributing roll 206 includes an outer surface 207 contacting the outer surface 203 of the pressure roll 202. The heat distributing roll 206 may include a heating element 209. For example, the heating element 209 may disposed inside of the distributing roll 206. The heating element 209 may be configured for heating the outer surface 207.

In embodiments, the pressure roll 202 includes an outer layer 212 having the outer surface 203. The outer layer 212 overlies a rigid core, which can be comprised of aluminum, aluminum alloys, steels, or the like. In embodiments, the outer layer 212 is comprised of an elastically deformable material having low-surface energy and low-friction properties, such as polytetrafluoroethylene (Teflon®). The low surface energy material is effective to facilitate the release and stripping of media/marking material from the outer surface 203.

In embodiments, the belt 204 is comprised of a metal, such as steel, stainless steel, aluminum, aluminum alloys, or the like, or a polymeric material, such as polyimide, polyamide, or the like. The belt 204 is elastically deformable. The belt 204 typically has a wall thickness of about 0.02 mm to about 150 mm.

A heater 216 is located inside of the belt 204. The heater 216 contacts the inner surface 210 and is operable to heat the belt 204 as it rotates through the nip 214. A power supply (not shown) is connected to the heater 216 and powers the heater 216 to heat the belt 204 at the nip 214 to the desired temperature for treating marking material carried on media fed to the nip 214. The pressure roll 202 is driven to turn by a drive mechanism to cause the belt 204 to rotate in the opposite direction in order to convey media though the nip 214 in the process direction (toward the right in FIG. 2).

Different types of media can be treated in the fuser 200. For example, the media can be light-weight, medium-weight or heavy-weight paper sheets. The media can be coated or uncoated.

A solid, low-surface energy material, such as Teflon®, or the like, can be applied to surfaces of the heater 216 and heater housing 218 that contact the inner surface 210 of the belt 204 to reduce friction between these surfaces and the inner surface 210 as the belt 204 rotates.

In embodiments, the heater 216 is attached to the heater housing 218, which is stationary. A load bar 220 applies a downward-acting force on the heater housing 218 in the illustrated orientation of the fuser 200 to elastically deform (flatten) the belt 204 at the nip 214. This deformation of the belt 204 increases the amount of heat transfer between the outer surface 208 of the belt 204 and media fed to the nip 214.

FIG. 3 illustrates another exemplary embodiment of a fuser 300. Embodiments of the fuser 300 can also be used, e.g., in the printing apparatus 100 in place of the fuser 110. The fuser 300 includes a heat roll 302 and a continuous belt 304. The belt 304 includes an outer surface 308. The belt 304 is supported on a stationary core 309 about which the belt 304 rotates. A low-friction solid material (e.g., Teflon®, or the like) or a lubricant can be applied to the outer surface of the core 309 to reduce friction between the outer surface and the inner surface of the rotating belt 304.

The heat roll 302 includes an outer layer 303 with an outer surface 312 contacting the outer surface 308 of the belt 304 to form a nip 314. In embodiments, the outer layer 303 is comprised of a low-surface energy and low-friction material, such as Teflon®, or the like, which is effective to facilitate the release and stripping of media/marking material from the outer surface 312. The outer layer 303 can be formed over an elastomeric material, such as silicone rubber, or the like, overlying the core 305. The heat roll 302 is driven to turn by a drive mechanism to cause the belt 304 in contact with the heat roll 302 to rotate in the opposite direction in order to convey media though the nip 314 in the process direction (toward the right in FIG. 3).

In embodiments, one or more heating elements 320 (three are shown) are located inside of the core 305 of the heat roll 302. The heating elements 320 can be, e.g., axially-extending lamps. The heating elements 320 are connected to a power supply (not shown) in a conventional manner. The heating elements 320 heat the outer surface 312 of the heat roll 302 to a sufficiently-high temperature to treat marking material carried on media fed to the nip 314, e.g., to fuse the marking material to the media.

In embodiments, the belt 304 can have the same composition and wall thickness as the belt 208 shown in FIG. 2, for example. The belt 304 is deformed at the nip 314 by contact with the heat roll 302.

Figure 4:
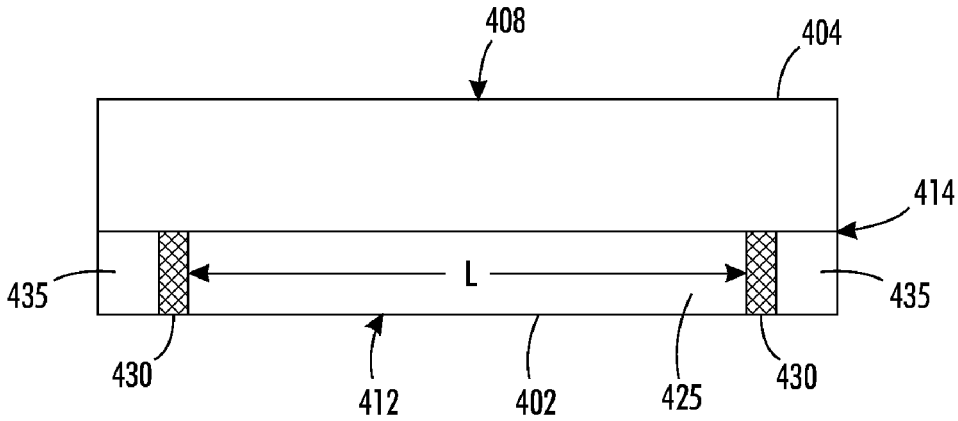
FIG. 4 depicts a side view of an exemplary embodiment of a fuser including a belt and a pressure roll having roughened, high-friction regions.
Figure 5:
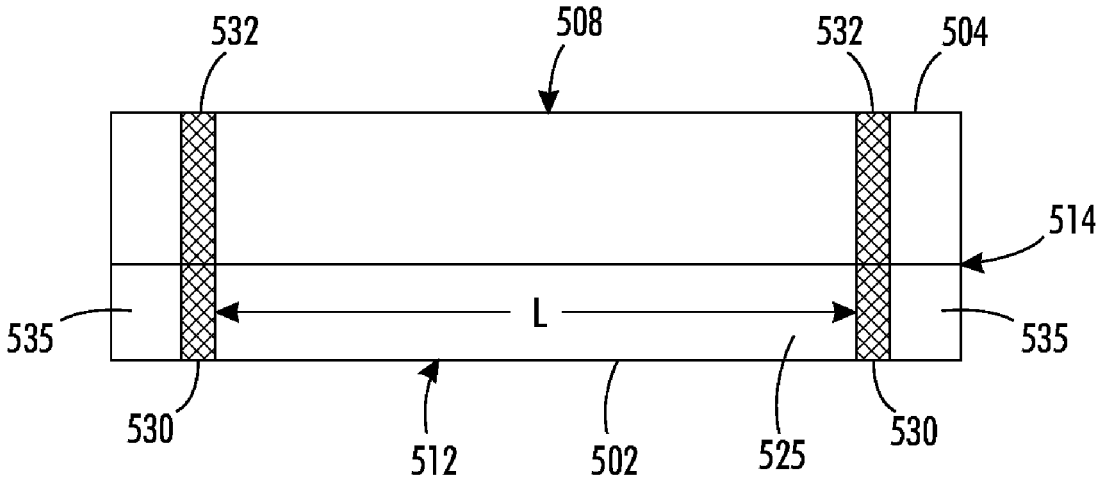
FIG. 5 depicts a side view of another exemplary embodiment of a fuser including a belt and a pressure roll each having roughened, high-friction regions.
Figure 6:
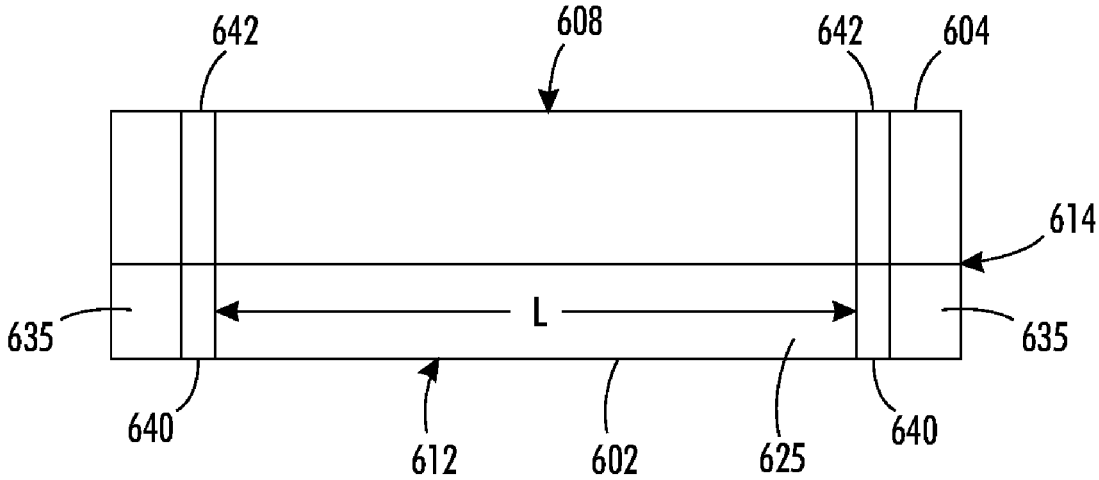
FIG. 6 depicts a side view of another exemplary embodiment of a fuser including a belt and a pressure roll each having high-friction regions comprised of a high-friction material.

FIGS. 4 to 6 depict exemplary embodiments of fusers including high-friction surfaces for increasing the amount of torque that can be transmitted between members in contact with each other during rotation of the members. FIG. 4 shows a fuser 400 including a pressure roll 402 and a continuous belt 404. The pressure roll 402 includes an outer surface 412 and the belt 404 includes an outer surface 408 forming a nip 414 with the outer surface 412. Media are fed to the nip 414 to treat marking material carried on the media. The pressure roll 402 and belt 404 can include the same elements and have the same configurations as the pressure roll 202 and belt 204 of the fuser 200, for example.

The pressure roll 402 includes high-friction surfaces 430. The high-friction surfaces 430 are axially spaced from each other along the length of the pressure roll 402, and extend circumferentially around the pressure roll 402. The outer surface 412 includes an inner portion 425 between the high-friction surfaces 430. The inner portion 425 defines the media path of media passing through the nip and has a length, L. The high-friction surfaces 430 lie outside of the media path. The pressure roll 402 can include more than one high-friction surface 430 axially outward from each end of the inner portion 425. The high-friction surfaces can have the same or different roughness. For example, a higher amount of drive may be desired at one end than at another end of the pressure roll 402. The outer surface 412 further includes outer portions 435 adjacent to the high-friction surfaces 430. The high-friction surfaces 430 can have a width dimension along the length of the pressure roll 402 (between the edges of the inner portion 425 and outer portions 435) of about 5 mm to about 50 mm, for example.

In embodiments, the pressure roll 402 includes a metallic core comprised of aluminum, an aluminum alloy, steel, stainless steel, or the like. The core is exposed at the outer portions 435 of the outer surface 412.

In embodiments, the inner portion 425 of the outer surface 412 is comprised of a low-surface energy and low-friction material, such as Teflon®, or the like, which overlies the core, or an elastomeric material formed on the core. The inner portion 425 can be a sleeve or a coating. In embodiments, the inner portion 425 is smooth. For example, the inner portion 425 can have a roughness of less than about 1.2 μm Ra. The low-surface energy material is effective to reduce friction between the inner portion 425 and the outer surface 408 of the belt 404 during rotation of these members, and to reduce friction between the inner portion 425 and media/marking material.

In embodiments, the high-friction surfaces 430 are roughened surfaces formed by roughening the outer surface of the metallic core or coating. In embodiments, the high-friction surfaces 430 can have the desired as-formed roughness resulting from the process used to form the core. For example, the core can be produced using a casting mold having an inner surface roughened at locations corresponding to the locations of the high-friction surfaces. In other embodiments, the outer surface of the core can be mechanically roughened and/or chemically roughened by any suitable technique that can produce the desired roughened surface. For example, the roughened outer surfaces can be produced by grinding, abrasives, blasting, or the like, and/or by a chemical treatment, such as chemical etching, to produce the desired surface texture and roughness. The high-friction surfaces 430 can typically have a roughness of about 1 to about 7 μm Ra, such as at least about 2 μm Ra, at least about 3 μm Ra, at least about 4 μm Ra, at least about 5 μm Ra, or at least about 6 μm Ra.

The high-friction surfaces 430 have a sufficiently-high roughness to increase the amount of torque that can be transmitted by the pressure roll 402 to the belt 404 as these members rotate in contact with each other by at least a desired amount. The level of torque that can be transmitted is a function of the level of roughness of the high-friction surfaces 430. In embodiments, the torque transmitted between the members can be increased by at least about 15%, at least about 30%, at least about 40%, at least about 50%, or higher. The high-friction surfaces 430 can continue to provide this increased torque and drive force for a large number of prints, such as at least 100,000, 200,000, or more prints, in the fuser 400. The high-friction surfaces 430 can reduce, and desirably eliminate, slip or stall in the fuser 400. The high-friction surfaces 430 enable a smaller portion of the drive force between the pressure roll 402 and belt 404 to be transmitted through the images and media than is transmitted without the high-friction surfaces 430. Consequently, better image quality can be achieved.

FIG. 5 shows another exemplary fuser 500 including a pressure roll 502 and a continuous belt 504. The pressure roll 502 includes an outer surface 512 and the belt 504 includes an outer surface 508. The outer surfaces 508, 512 form a nip 514 to which media are fed. The pressure roll 502 and belt 504 can include the same elements and have the same configurations as the pressure roll 402 and belt 404 of the fuser 400, for example.

The pressure roll 502 includes high-friction surfaces 530 and the belt 504 includes high-friction surfaces 532 contacting the high-friction surfaces 530. By providing high-friction surfaces on both the pressure roll 502 and the belt 504, the amount of torque that can be transmitted to the belt 504 is increased. The high-friction surfaces 530 are axially spaced from each other along the pressure roll 502, and extend circumferentially around the pressure roll 502. The outer surface 512 includes an inner portion 525 between the high-friction surfaces 530. The high-friction surfaces 530, 532 are outside of the media path. The pressure roll 502 and belt 504 can include more than one high-friction surface 530, 532, respectively, disposed outward from each end of the inner portion 525. The inner portion 525 defines the media path and has a length, L. The outer surface 512 further includes outer portions 535 adjacent to the high-friction surfaces 530. The high-friction surfaces 530, 532 can have a width dimension along the directions of the lengths of the pressure roll 502 and belt 504 of about 5 mm to about 50 mm, for example.

In embodiments, the pressure roll 502 includes a metallic core exposed at the outer portions 535 of the outer surface 512. The inner portion 525 of the outer surface 512 is comprised of a low-surface energy and low-friction material, such as Teflon®, or the like, which overlies the core, or of an elastomeric material formed on the core. The inner portion 525 can be a sleeve or coating. In embodiments, the inner portion 525 is smooth. For example, the inner portion 425 can have a roughness of less than about 1.2 μm Ra. The low surface energy material is effective to reduce friction between the inner portion 525 and the outer surface 508 of the belt 504 during rotation of these members, and to reduce friction between the inner portion 525 and media and marking material on the media.

In embodiments, the high-friction surfaces 530 and 532 are roughened surfaces formed by roughening the outer surface of the metallic core and the outer surface 508 of the belt 504, respectively. In embodiments, the high-friction surfaces 530 can have the desired as-formed roughness resulting from the process used to form the core. In other embodiments, the outer surface of the core and the outer surface 508 of the belt 504 can be mechanically and/or chemically roughened by any suitable technique that can produce the desired roughened surface, such as the techniques described with respect to the fuser 400. The roughened surface 530, 532 can typically have a roughness of about 2 to about 7 μm Ra, such as at least about 3 μm Ra, at least about 4 μm Ra, at least about 5 μm Ra, or at least about 6 μm Ra. The roughened surfaces 530, 532 can have the same roughness as, or a different roughness than, the high-friction surfaces 430.

The high-friction surfaces 530, 532 have a sufficiently-high roughness to increase the amount of torque that can be transmitted by the pressure roll 502 to the belt 504 during rotation of these members by at least a desired amount. In embodiments, the torque can be increased by at least about 15%, at least about 30%, at least about 40%, at least about 50%, or more. The high-friction surfaces 530, 532 can continue to provide this increased torque and drive force for a large number of prints, such as at least about 100,000, 200,000, or more prints, in the fuser 500. The high-friction surfaces 530, 532 can reduce, and desirably eliminate, slip or stall in the apparatus. Additionally, the high-friction surfaces 530, 532 enable a smaller portion of the drive force between the pressure roll 502 and belt 504 to be transmitted through the images and media than is transmitted without the high-friction surfaces 530, 532, allowing better image quality to be achieved.

FIG. 6 shows another exemplary fuser 600 including a pressure roll 602 and a continuous belt 604. The pressure roll 602 includes an outer surface 612 and the belt 604 includes an outer surface 608. The outer surfaces 608, 612 form a nip 614 to which media carrying marking material are fed. The pressure roll 602 and belt 604 can include the same elements and have the same configurations as the pressure roll 402 and belt 404 of the fuser 400, for example.

The pressure roll 602 includes high-friction surfaces 640 and the belt 604 includes high-friction surfaces 642. The high-friction surfaces 640, 642 are axially spaced from each other along the length dimensions of the pressure roll 602 and belt 604, respectively, and extend circumferentially around the pressure roll 602 and belt 604. The outer surface 612 includes an inner portion 625 between the high-friction surfaces 640. The inner portion 625 defines the media path and has a length, L. The high-friction surfaces 640, 642 are outside of the media path. The pressure roll 602 and belt 604 can include more than one high-friction surface 640, 642, respectively, disposed outward from each end of the inner portion 625. The outer surface 612 further includes outer portions 635 adjacent to the high-friction surfaces 640. The high-friction surfaces 640, 642 can have a width dimension along the axial dimensions of the pressure roll 602 and belt 604 of about 5 mm to about 50 mm, for example.

In embodiments, the pressure roll 602 includes a metallic core exposed at the outer portions 635 of the outer surface 612. The inner portion 625 of the outer surface 612 is comprised of a low-surface energy material, such as Teflon®, Viton®, or other fluoropolymers, which overlies the core, or an elastomeric material applied to the core. The inner portion 625 can be a sleeve or coating. In embodiments, the inner portion 625 is smooth. The inner portion 625 can typically have a roughness of less than about 1.5 μm Ra, such as less than about 1 μm Ra. The low surface energy material is effective to reduce friction between the inner portion 625 and the outer surface 608 of the belt 604 between the high-friction surfaces 642 during rotation of these members, and to reduce friction between the inner portion 625 and media/marking material.

In embodiments, the high-friction surfaces 640, 642 comprise any suitable high-friction material that has a sufficiently-high coefficient of friction to increase the amount of torque that can be transmitted by the pressure roll 602 to the belt 604 during rotation of these members by at least a desired amount. For example, the high-friction materials can be polymers, such as silicones; fluoroelastomers, such as Viton®; ceramics; or metals. Typically, the surface roughness range of the high-friction surfaces 640, 642 is about 0.5 to about 7 μm Ra, such as at least about 1 μm Ra, at least about 2 μm Ra, at least about 3 μm Ra, at least about 4 μm Ra, at least about 5 μm Ra, or at least about 6 μm Ra. The high-friction materials have a higher coefficient of friction than the material forming the inner portion 625.

In embodiments, the high-friction surfaces 640 can be formed by leaving opposed end portions of an elastomeric material applied to the core exposed, i.e., not covered by the low surface energy material. In the embodiments, the elastomeric material is a high-friction material.

In other embodiments, the high-friction material can be applied over the core of the pressure roll 602 adjacent to each end of the inner portion 625. Depending on the high-friction material selected, the material can be applied directly to the core by a suitable process. For example, the high-friction material can be applied by a coating process, e.g., spraying, dipping, or the like, or the high-friction material can be in the form of a pre-formed sleeve, which is bonded to the core, or to an intermediate material used to enhance adhesion of the sleeve to the core.

The high-friction material forming the high-friction surfaces 642 of the belt 604 can be applied directly to the outer surface 608 by a coating process, or the high-friction material can be in the form of a sleeve, which is bonded to the outer surface 608, or to an intermediate material used to enhance adhesion of the sleeve to the outer surface 608.

The high-friction surfaces 640, 642 have sufficient roughness to increase the amount of torque that can be transmitted by the pressure roll 602 to the belt 604 during rotation of these members. In embodiments, the torque can be increased by at least about 15%, at least about 30%, at least about 40%, at least about 50%, or higher. The high-friction surfaces 640, 642 can continue to provide this increased torque and drive force for a large number of prints, such as at least 100,000, at least 200,000, or more prints, in the fuser 600. The high-friction surfaces 640, 642 can reduce, and desirably eliminate, slip or stall in the apparatus. Additionally, the high-friction surfaces 640, 642 enable a smaller portion of the drive force between the pressure roll 602 and belt 604 to be transmitted through the images and media than is transmitted without the high-friction surfaces 640, 642, allowing better image quality to be achieved.

In embodiments, high-friction surfaces can be formed on members of fusers having a different construction than the fuser 200. For example, high-friction surfaces, which are either roughened surfaces or comprise materials having high roughness, can be formed on the outer surface 312 of the heat roll 302 and/or the outer surface 308 of the belt 304 shown in FIG. 3.

As described herein, the high-friction surfaces can be formed on various drive and driven members in apparatuses useful for printing. For example, in the fuser 200, high-friction surfaces can be formed on the pressure roll 202; on the belt 204, such as shown in FIGS. 5 and 6; and on the outer surface 207 of the heat distributing roll 206 (such as the high-friction surfaces on the pressure rolls 402, 502, 602 shown in FIGS. 4 to 6) to contact high-friction surfaces on the pressure roll 202 to increase torque transmitted between the pressure roll 202 and heat distributing roll 206.

In other embodiments, the apparatuses useful for printing can include a roll, such as the pressure roll 202 shown in FIG. 2 or the heat roll 302 shown in FIG. 3, forming a nip with a second roll. In such embodiments, the driven roll, or both rolls, can have high-friction surfaces contacting the other roll to enhance torque transmission between the members. The high-friction surfaces can be roughened surfaces or high-friction materials.

Although the above description is directed toward fusers used in xerographic printing, it will be understood that the teachings and claims herein can be applied to any treatment of marking material on a medium in apparatuses useful for printing. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a first member including a first outer surface;

a roll including a second outer surface forming a nip with the first outer surface, the second outer surface including an inner portion having first and second axially-spaced edges, a roughened first high-friction surface axially outward from the first edge and a roughened second high-friction surface axially outward from the second edge, the first and second high-friction surfaces extending circumferentially around the roll and having a higher roughness than the inner portion;

wherein the inner portion and the first and second high-friction surfaces contact the first outer surface at the nip, and the first and second high-friction surfaces lie outside of a media path through the nip; and a heat distributing roll including a third outer surface contacting the second outer surface of the roll, the third outer surface including axially-spaced, high-friction surfaces contacting the first and second high-friction surfaces.

2. The apparatus of claim 1, wherein the first member is a continuous metallic belt or polymer belt.

3. The apparatus of claim 2, further comprising a heater which is disposed inside of the belt and includes a heating surface contacting an inner surface of the belt at the nip.

4. The apparatus of claim 3, further comprising:

a heater housing; and a load member configured to apply a load to the heater housing to urge the heating surface into contact with the inner surface of the belt at the nip.

5. The apparatus of claim 1, wherein:

the first outer surface comprises an inner portion having third and fourth axially-spaced edges, a roughened third high-friction surface axially outward from the third edge and contacting the first high-friction surface, and a roughened fourth high-friction surface axially outward from the fourth edge and contacting the second high-friction surface; and the third and fourth high-friction surfaces each extend circumferentially around the belt, have a higher roughness than the inner portion of the first member and lie outside of the media path through the nip.

6. The apparatus of claim 1, wherein the inner portion of the second outer surface comprises a smooth, low surface energy material effective to reduce friction between the inner portion and the first outer surface during rotation of the roll and first member.

7. The apparatus of claim 1, further comprising at least one heating element disposed inside of the roll for heating the second outer surface.

8. An apparatus useful for printing, comprising:

a first member including a first inner portion having first and second axially-spaced edges, a first high-friction surface axially outward from the first edge and a second high-friction surface axially outward from the second edge, the first and second high-friction surfaces extending circumferentially around the first member and being comprised of a first high-friction material having a higher coefficient of friction than a material forming the first inner portion;

a roll including a second outer surface forming a nip with the first outer surface, the second outer surface including a second inner portion having third and fourth axially-spaced edges, a third high-friction surface axially outward from the third edge and a fourth high-friction surface axially outward from the fourth edge, the third and fourth high-friction surfaces extending circumferentially around the roll and being comprised of a second high-friction material having a higher coefficient of friction than a material forming the second inner portion;

wherein the first high-friction surface contacts the third high-friction surface, the second high-friction surface contacts the fourth high-friction surface, the first inner portion contacts the second inner portion, and the first, second, third and fourth high-friction surfaces lie outside of a media path through the nip; and a heat distributing roll including a third outer surface contacting the second outer surface of the roll, the third outer surface including axially-spaced, high-friction surfaces contacting the third and fourth high-friction surfaces.

9. The apparatus of claim 8, wherein:

the first member is a continuous metallic belt or polymer belt;

the first high-friction material is a polymeric material;

the second high-friction material is a polymeric material;

the second inner portion of the second outer surface comprises a smooth, low-friction polymeric material effective to reduce friction between the second inner portion and the first outer surface during rotation of the roll and first member.

10. The apparatus of claim 9, further comprising a heater disposed inside of the belt, the heater including a heating surface contacting an inner surface of the belt at the nip.

11. The apparatus of claim 10, further comprising:

a heater housing; and a load member configured to apply a load to the heater housing to urge the heating surface into contact with the inner surface of the belt at the nip.

12. The apparatus of claim 8, further comprising at least one heating element disposed inside of the roll for heating the second outer surface.

13. A method of treating marking material on media in an apparatus useful for printing comprising a first member including a first outer surface, and a roll including a second outer surface forming a nip with the first outer surface, the second outer surface including an inner portion having first and second axially-spaced edges, a roughened first high-friction surface axially outward from the first edge and a roughened second high-friction surface axially outward from the second edge, the first and second high-friction surfaces each extending circumferentially around the roll and having a higher roughness than the inner portion, the method comprising:

feeding a medium carrying marking material to the nip; and contacting the medium with the first outer surface and the inner portion of the roll to treat the marking material at the nip, the first and second high-friction surfaces lying outside of a media path through the nip and not contacting the medium, wherein a heat distributing roll including axially-spaced, high-friction surfaces contacting the first and second high-friction surfaces.

14. The method of claim 13, wherein:

the first member is a continuous metallic belt, the first outer surface comprises an inner portion having third and fourth axially-spaced edges, a roughened third high-friction surface axially outward from the third edge and contacting the first high-friction surface, and a roughened fourth high-friction surface axially outward from the fourth edge and contacting the second high-friction surface, the third and fourth high-friction surfaces each extend circumferentially around the belt and have a higher roughness than the inner portion of the belt; and the third and fourth high-friction surfaces lie outside of the media path through the nip and do not contact the medium.

15. The method of claim 13, wherein the inner portion of the second outer surface comprises a smooth, low-friction polymeric material effective to reduce friction between the inner portion and the first outer surface during rotation of the roll and first member.

16. The method of claim 13, wherein the first member is a continuous metallic belt including an inner surface which is heated at the nip with a heater disposed inside of the belt.

17. The method of claim 13, further comprising heating the second outer surface of the roll with at least one heating element disposed inside of the roll.

* * * * *